US005634833A

United States Patent [19]

Watanabe

[11] Patent Number: 5,634,833

[45] Date of Patent: Jun. 3, 1997

[54] FLUSHING SYSTEM FOR OUTBOARD MOTOR

[75] Inventor: Hitoshi Watanabe, Hamamatsu, Japan

[73] Assignee: Sanshin Kogyo Kabushiki Kaisha, Hamamatsu, Japan

[21] Appl. No.: 414,712

[22] Filed: Mar. 31, 1995

[30] Foreign Application Priority Data

Mar. 31, 1994 [JP] Japan ..... 6-063777

[51] Int. Cl.[6] ..... B63H 20/30

[52] U.S. Cl. ..... 440/88; 440/113

[58] Field of Search ..... 440/88, 113, 77; 134/166 R, 167 R, 169 A

[56] References Cited

U.S. PATENT DOCUMENTS 2,604,867 7/1952 Frye ..... 440/88
2,644,474 7/1953 Houchin ..... 134/166 R
5,018,998 5/1991 Kato ..... 440/77
5,045,001 9/1991 Borst ..... 440/88

*Primary Examiner*—Sherman Basinger
*Attorney, Agent, or Firm*—Knobbe, Martens, Olson & Bear LLP

[57] ABSTRACT

An improved flushing system for an outboard motor that is comprised of a flexible conduit that is connected to the coolant path for the cooling jacket of the outboard motor between the water inlet and the engine cooling jacket so that plugging of the water inlet and water outlet during flushing is not required. The flexible conduit has a hose-type fitting at its open end for attachment to a hose for flushing purposes, and also for attachment to a closure plus fixed to the tray of the outboard motor protective cowling for closing the flexible conduit when not in use.

12 Claims, 4 Drawing Sheets

FLUSHING SYSTEM FOR OUTBOARD MOTOR

BACKGROUND OF THE INVENTION

This invention relates to a flushing system for an outboard motor and more particularly to an improved and simplified arrangement for flushing the cooling jacket of an outboard motor.

As is well known, most outboard motors have liquid cooling systems that operate by drawing water from the body of water in which the associated watercraft is operated, circulating it through the cooling jacket of the engine, and returning the water back to the body of water once the engine has been cooled. This obviously results in a wide variety of water conditions that pass through the engine cooling jacket. Therefore, it has been practice for the operators to flush the cooling system of the engine from time to time. This is particularly desirable when the outboard motor has been operating in a marine (salt water) environment.

Many types of "flushing cuffs" have been provided. These are devices that attach around the water inlet portion of the outer housing which is normally located in the lower unit. These cuffs have a fitting to which a hose can be attached, and thus city water can be employed for flushing the outboard motor. Obviously, these devices are not particularly convenient and they normally require removal of the outboard motor from the watercraft or removal of the watercraft with the attached outboard motor from the body of water.

Another type of device has been proposed wherein the outboard motor is provided with a fitting that is connected to the cooling circuit and to which a hose may be attached. Frequently, this fitting also serves as the tell-tale for the cooling system, and such an arrangement is shown in FIG. 1.

Referring specifically to FIG. 1, an outboard motor is identified generally by the reference numeral 11 and is comprised of a power head, indicated by the reference numeral 12, which is comprised of a powering, water-cooled internal combustion engine 13 and a surrounding protective cowling comprised of a lower tray portion 14 and a detachably connected main cowling portion 15.

Various types of internal combustion engines may be employed, and these engines are frequently provided with internal cooling jackets, indicated by the reference numeral 16 and shown in phantom. Since the construction of the engine 13 per se and its cooling jacket 16 forms no part of the invention, the construction of the prior art engines and cooling jackets and that of the invention will not be described further.

The engine 13, as is typical with outboard motor practice, is supported so that its output shaft rotates about a vertically extending axis. This output shaft is coupled to a drive shaft (not shown) that depends into a drive shaft housing 17 which depends from the power head 12. This drive shaft housing terminates in a lower unit 18 where the drive shaft is coupled to a forward/neutral/reverse transmission (not shown) so as to drive a propulsion device such as a propeller, which also is not illustrated in this figure.

A coolant pump 19 is disposed at the interface between the drive shaft housing 17 and the lower unit 18. This coolant pump 19 is driven by the drive shaft in a manner well known. The coolant pump 19 draws water from the body of water in which the outboard motor 11 is operating, through a water inlet opening 21 formed in the lower unit 18. This water is then delivered to the engine cooling jacket 16 through an internal conduit 22 that extends upwardly through the drive shaft housing 18.

After the water has circulated through the engine cooling jacket 16, it is dumped into a return conduit 23. The conduit 23 discharges into the exhaust system which is normally contained within the drive shaft housing 17 for discharge of the water along with the exhaust gases through an underwater exhaust gas discharge, indicated at 24. This discharge 24 may comprise a through-the-hub propeller discharge.

In addition, there is provided a small above-the-water discharge 25 through which a portion of the cooling water is normally discharged so as to provide a visual indication to the operator (tell-tale) that coolant is being circulated through the engine cooling jacket.

In accordance with one type of prior art device, a Valve assembly 26 is provided at the discharge end of the tell-tale 25 and which permits a small amount of water flow under all conditions. This may also include, in addition to a check-type valve, a manual valve that may be manually closed to a restricted position and opened to a full-flow position.

In this open full-flow position, a male fitting 27 of a garden hose 28 may be threaded so that water may be flushed through the cooling system. Because this flushing attachment is at the rear of the outboard motor, it is difficult to utilize when the outboard motor is attached to a transom of a watercraft, as shown partially and in cross section at 29. In addition, the flow of flushing water is opposite to that of the normal flow path, and it may be desirable or necessary to plug or otherwise close the underwater exhaust gas discharge 24 to ensure that the flow will pass through the cooling jacket 16 and not merely be discharged through the discharge opening 24 without ever flushing the cooling jacket 16.

From this description it should be readily apparent that this type of prior art construction, although it has some advantages over the cuff-type flushing system, does have some areas that can be improved upon. For example, the type of valve arrangement that must be employed requires not only manual operation, but also requires the provision of a check-type valve, which adds to the cost of the assembly. Furthermore, these systems may also be prone to leakage. Furthermore, and as has been noted, the attachment of the hose for flushing purposes is difficult, particularly when the watercraft still is in the body of water.

It is, therefore, a principal object of this invention to provide an improved flushing system for an outboard motor.

It is a further object of this invention to provide a flushing system for an outboard motor that offers flexibility in attachment of the flushing hose to the system and which permits flushing even when the watercraft remains in the body of water.

It is a further object of this invention to provide an improved flushing system for an outboard motor that does not require a valve for its operation.

Referring again to FIG. 1, the additional conventional components of the outboard motor 11 will be described, as this description will also be used in lieu of a detailed description of these conventional components in conjunction with the invention.

A steering shaft (not shown) is connected in a suitable manner to the drive shaft housing 18. This steering shaft is journalled within a swivel bracket 31 for steering of the outboard motor 11 about the steering axis defined by the swivel bracket 31. The swivel bracket 31 is, in turn, coupled by a horizontal tilt pin 32 to a clamping bracket 33 that is affixed to the watercraft transom 29 in a known manner. The pivot pin 32 permits tilt and trim movement of the outboard motor 11, as is well known in this art.

SUMMARY OF THE INVENTION

This invention is adapted to be embodied in a flushing system for a water-cooled outboard motor. The outboard motor is comprised of a water-cooled internal combustion engine having a cooling jacket and a propulsion device driven by the engine. An outer housing assembly contains at least some of the components of the outboard motor. A water inlet opening is formed in the outer housing for drawing water from a body of water in which the outboard motor is operating. A cooling water discharge is provided for discharging cooling water back to the body of water in which the outboard motor is operating after it has passed through the engine cooling jacket. Means are provided for circulating coolant in a cooling water path between the water inlet, the engine cooling jacket, and the cooling water discharge. A flexible conduit is connected at one end with the cooling water path and has a fitting at its other end for attachment to a source of flushing water.

DETAILED DESCRIPTION OF THE PREFERRED EMBODIMENT OF THE INVENTION

Figure 1:
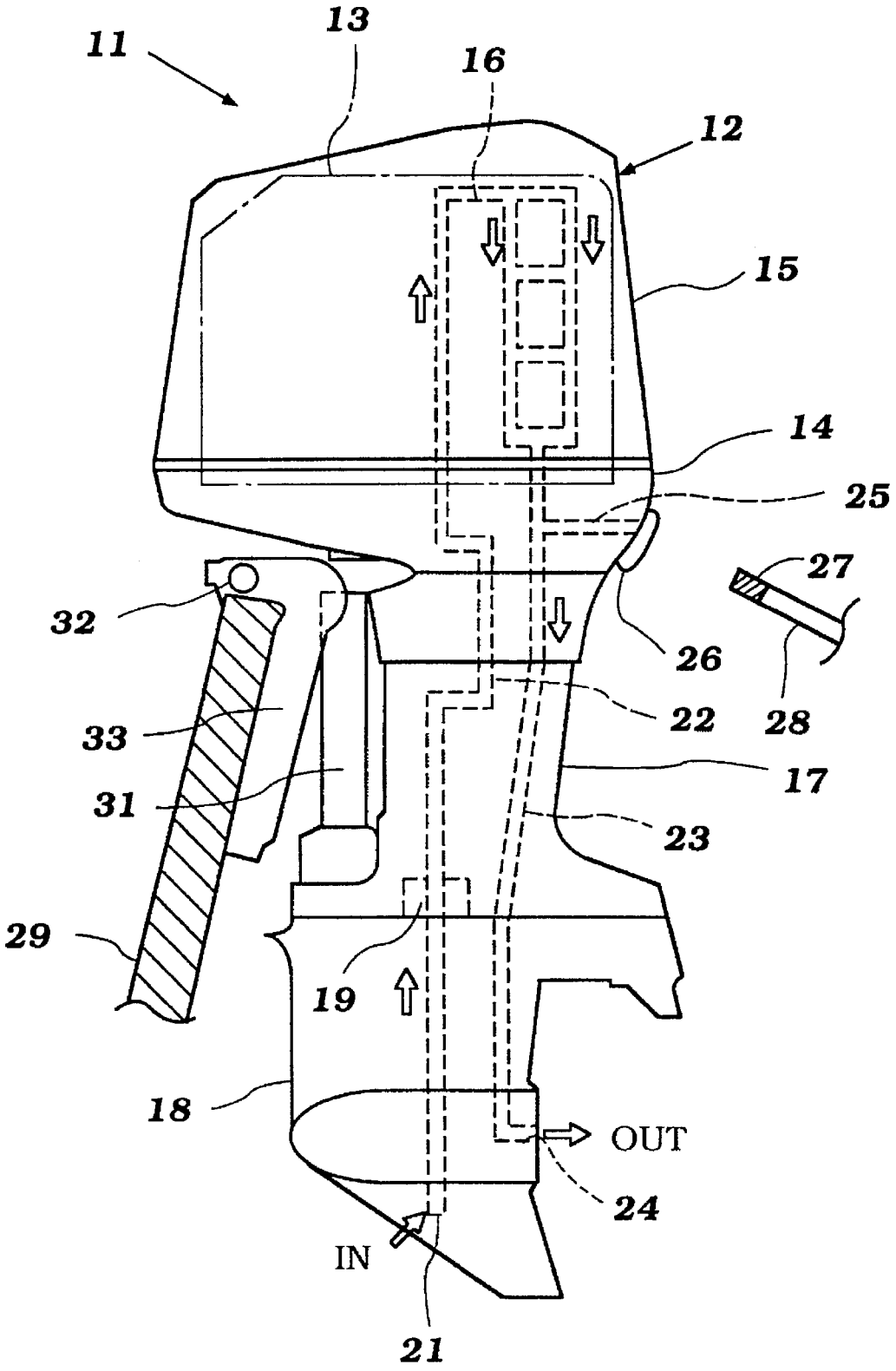
FIG. 1 is a side elevational view of a conventional type of outboard motor having a conventional flushing system and showing the outboard motor attached to the transom of a watercraft which is shown partially and in cross section.
Figure 2:
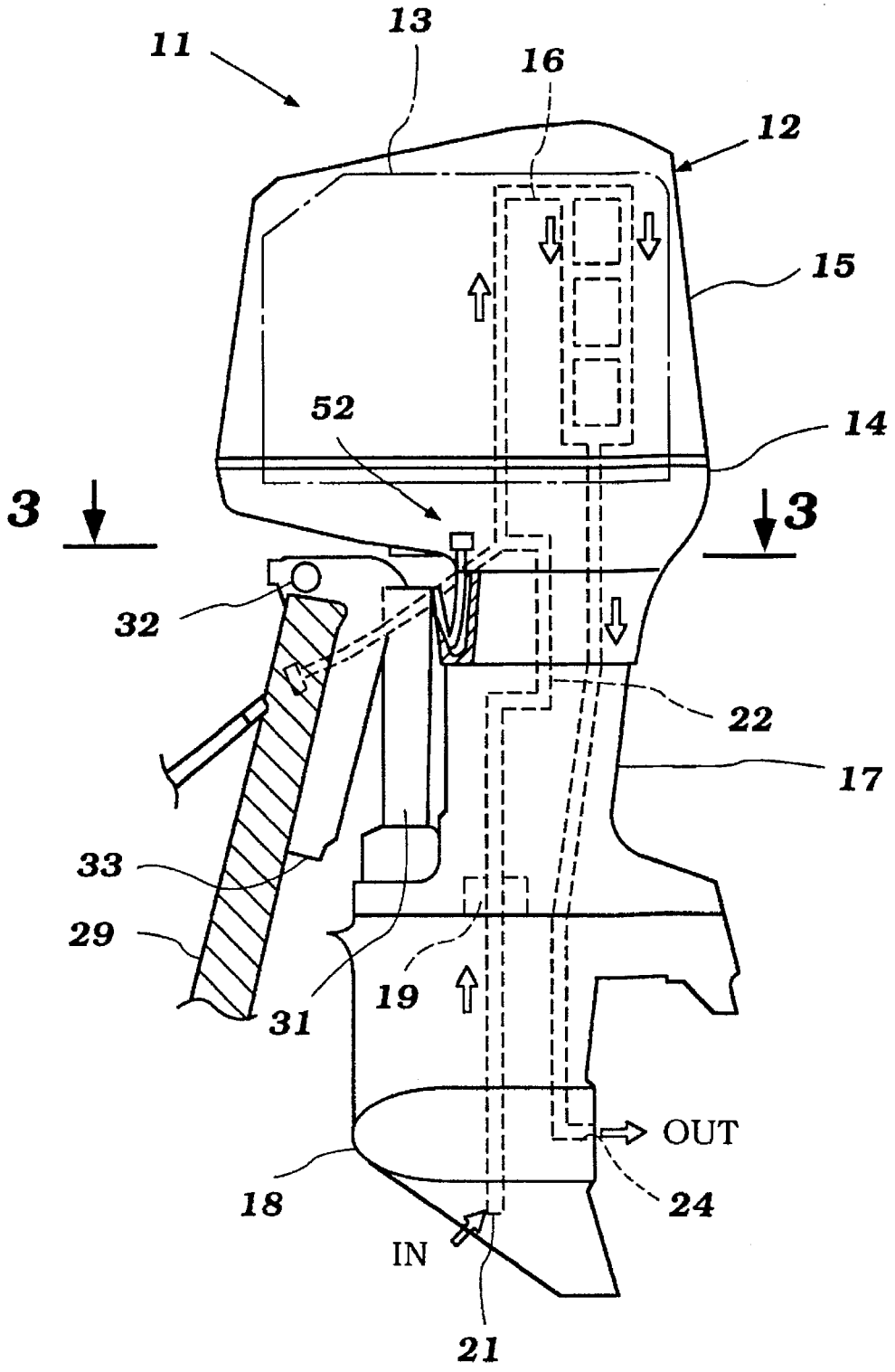
FIG. 2 is a view, in part similar to FIG. 1, and shows an outboard motor having a flushing system constructed in accordance with an embodiment of the invention. The flushing system is shown in this figure in its normal operating position in solid lines and in the flushing position in broken lines.
Figure 3:
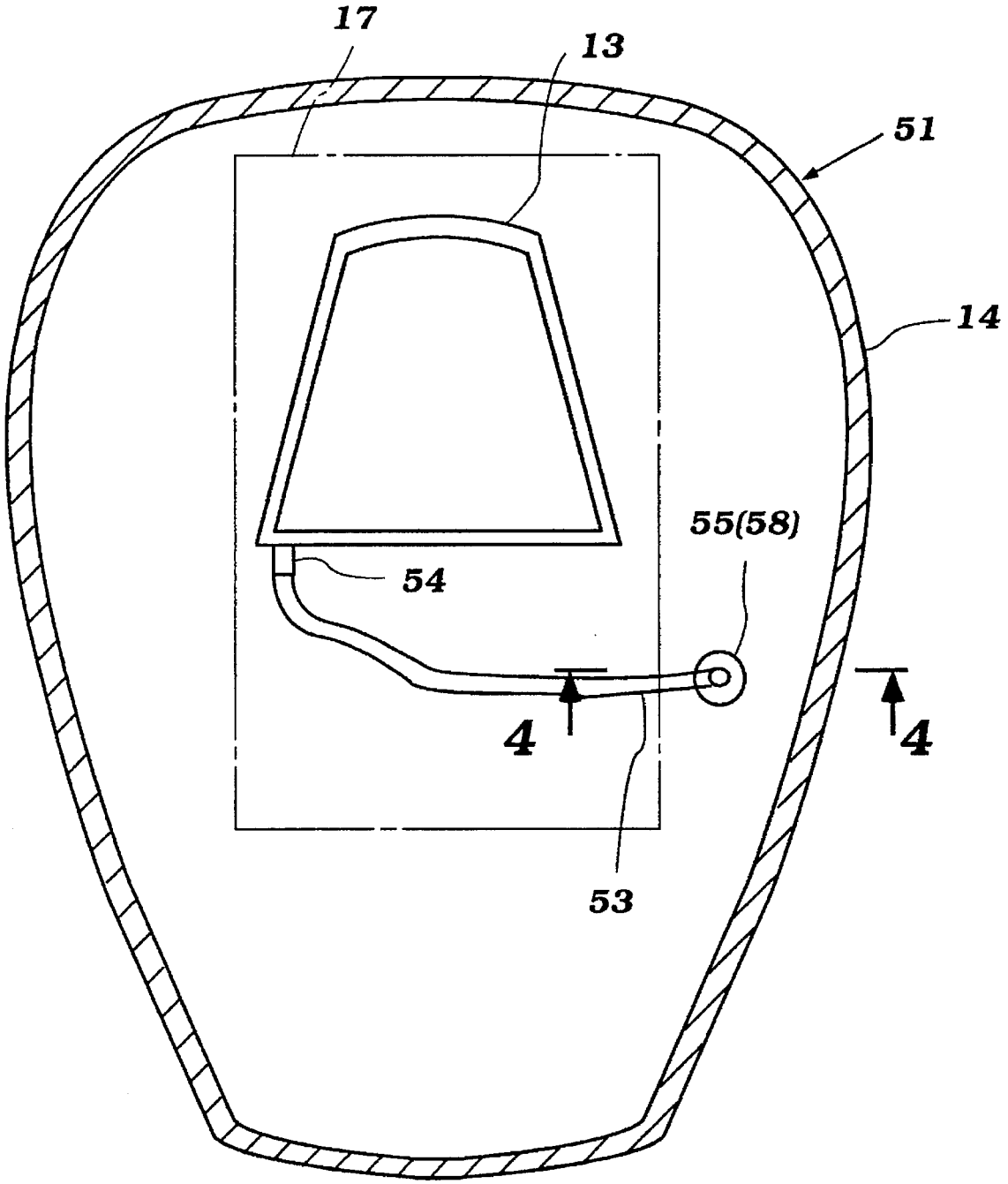
FIG. 3 is an enlarged cross-sectional view taken along the line 3—3 of FIG. 2.
Figure 4:
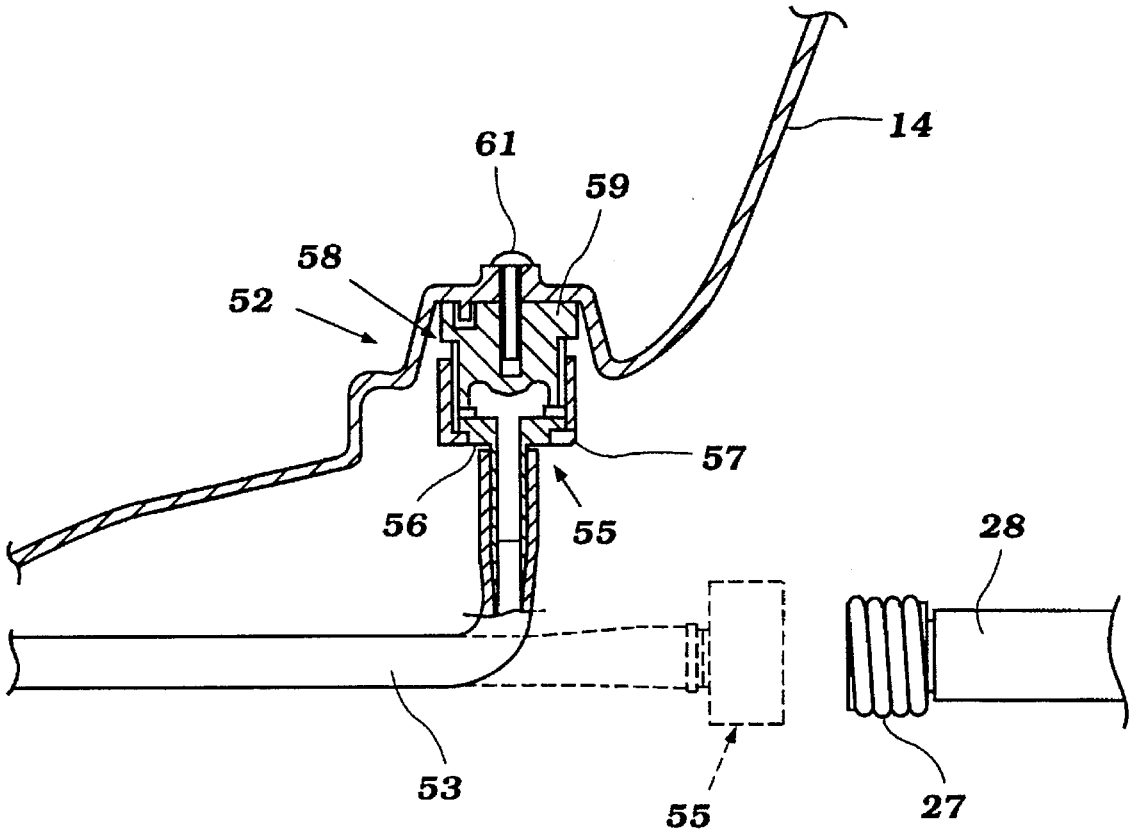
FIG. 4 is a cross-sectional view taken along the line 4—4 of FIG. 3, and again shows the flushing device in its normal operating position in solid lines and in a flushing position in broken lines.

Referring now to FIGS. 2–4, an outboard motor constructed in accordance with an embodiment of the invention is identified generally by the reference numeral 51. Except for the flushing system, which is indicated generally by the reference numeral 52, and its location, the outboard motor 51 has the same general construction as the prior art type of outboard motor shown in FIG. 1. Where that is the case, the components of the outboard motor 51 have been identified by the same reference numerals and will not be described again, except insofar as is necessary to understand the construction and operation of the embodiment of the invention.

The flushing device 52 is disposed at the front of the outboard motor 51, as may be clearly seen in the figures, and thus can be easily operated, even when the watercraft 29 is still in the body of water. The flushing device 52 is comprised of a flexible conduit 53 that has a connection 54 at one end to the cooling jacket 16 of the engine 13 adjacent its inlet side where the conduit 22 supplies water to the engine cooling jacket 16.

At the other end, the flexible conduit 53 is provided with a generally conventional type of female hose fitting, indicated generally by the reference numeral 55. This includes a fitting 56 that is connected to the conduit 53 and which has a female threaded outer portion 57 that is rotatable relative to the fitting 56 for tightening and loosening.

In order to provide a closure for the fitting 55 when it is not in use, and also so as to maintain the free end of the flexible conduit 53 in position, the underside of the tray 14 is provided with an attachment-closure member, indicated generally by the reference numeral 58. This includes a male threaded plug 59 that is affixed to the tray 14 by a fastener 61. The male threads of the plug 59 are complementary to that of the threaded member 57 of the fitting 55, so that the operator can close the conduit 53 by threading the fitting 55 onto the attachment-closure assembly 58. If desired, the plug 59 may be formed from an elastomeric material so as to assist in the sealing.

When it is desired to flush the engine cooling jacket 16, the flexible conduit fitting 55 is uncoupled, as shown in phantom lines in FIGS. 2 and 5, and then a male end 27 of the garden hose 28 may be easily attached for flushing purposes. Since the flexible conduit 53 is at the front of the outboard motor, as aforenoted, this can be done, even while the motor 51 is still attached to the watercraft transom 29 and when the watercraft is in the body of water. Also, since the connection is to the inlet to the cooling jacket 16, it will be assured that water will flow properly through the cooling jacket and not be discharged out of the outlet opening 24 prematurely. Also, flow through the inlet opening 21 will be precluded because the pump 19 will act like a one-way valve under this flushing condition.

Thus, it should be readily apparent from the foregoing description that the described embodiment well serves the desired goals. Of course, those skilled in the art will readily understand that the foregoing description is that of a preferred embodiment of the invention and that various changes and modifications may be made without departing from the spirit and scope of the invention as defined by the appended claims.

I claim:

1. A flushing system for a water-cooled marine propulsion system comprised of a water-cooled internal combustion engine having a cooling jacket, a propulsion unit driven by said engine, an outer housing assembly containing at least some of the components of said internal combustion engine and said propulsion unit, a water inlet opening in said outer housing for drawing water from a body of water in which said marine propulsion system is operating, a cooling water discharge for discharging cooling water back to the body of water in which said marine propulsion system is operating, means for circulating water in a cooling water path between said water inlet, said engine cooling jacket and said cooling water discharge, a flexible conduit connected at one end with said cooling water path and having a fitting at its other end for attachment to a source of flushing water, and a complementary fitting carried by said outer housing to which said fitting on said other end of said flexible conduit is adapted to be attached for closing said other end of said flexible conduit when not in use.

2. A flushing system as set forth in claim 1, wherein the connection of the flexible conduit to the cooling water path is disposed between the water inlet and the engine cooling jacket.

3. A flushing system as set forth in claim 2, wherein the marine propulsion system comprises an outboard motor and the flexible conduit is disposed in a power head of the outboard motor at the forward end thereof.

4. A flushing system as set forth in claim 3, wherein the power head is comprised of a lower tray and a main cover portion detachably connected to the tray and wherein the flexible conduit is disposed beneath and to the front of said tray.

5. A flushing system as set forth in claim 1, wherein the other end of the flexible conduit is not provided with a valve.

6. A flushing system as set forth in claim 4, wherein the one end of the flexible conduit is disposed at one side of the engine and the other end having the fitting is disposed on the other side of the engine.

7. A flushing system as set forth in claim 1, wherein the fitting comprises a female fitting on the flexible conduit and a male fitting fixed to the outer housing.

8. A flushing system as set forth in claim 7, wherein the connection of the flexible conduit to the cooling water path is disposed between the water inlet and the engine cooling jacket.

9. A flushing system as set forth in claim 8, wherein the flexible conduit is disposed in a power head of the marine propulsion system at the forward end thereof.

10. A flushing system as set forth in claim 9, wherein the power head is comprised of a lower tray and a main cover portion detachably connected to the tray and wherein the flexible conduit is disposed beneath and to the front of said tray.

11. A flushing system as set forth in claim 9, wherein the one end of the flexible conduit is disposed at one side of the engine and the other end having the fitting is disposed on the other side of the engine.

12. A flushing system as set forth in claim 1, wherein the one end of the flexible conduit is disposed at one side of the engine and the other end having the fitting is disposed on the other side of the engine.

* * * * *